United States Patent [19]

Falk

[11] Patent Number: 4,831,841

[45] Date of Patent: May 23, 1989

[54] COOLING SYSTEM FOR A MULTIPLE-PRODUCT MERCHANDISING MACHINE

[75] Inventor: Leonard P. Falk, Florissant, Mo.

[73] Assignee: UniDynamics Corporation, New York, N.Y.

[21] Appl. No.: 196,240

[22] Filed: May 20, 1988

[51] Int. Cl.[4] ..... F25D 25/02

[52] U.S. Cl. ..... 62/381; 62/255

[58] Field of Search ..... 62/381, 255

[56] References Cited

U.S. PATENT DOCUMENTS 2,722,807 11/1955 Downing ..... 62/381

3,769,805 11/1973 Corini ..... 62/381

*Primary Examiner*—Ronald C. Capossela

*Attorney, Agent, or Firm*—Senniger, Powers, Leavitt and Roedel

[57] ABSTRACT

A cooling system for a food storage and merchandising machine having a rotatable drum mounted inside a cabinet, the drum having a plurality of axially spaced shelves divided by partitions into a plurality of food storage compartments, comprising a hollow center column extending axially through the drum and through the centers of the shelves, the column having a sidewall defining an air passageway, the sidewall having a plurality of vents therein communicating with each of the food storage compartments. The system further comprises a refrigeration system for cooling air, and a blower for introducing cooled air into one end of the air passageway. The other end of the air passageway is closed so that substantially all of the air provided to the passageway passes through the vents. An air return duct, formed by at least one inner wall disposed remote from the drum, adjacent the walls of the cabinet, receives air which has passed from the air passageway through the compartments, and returns the air to the refrigeration system.

12 Claims, 4 Drawing Sheets

COOLING SYSTEM FOR A MULTIPLE-PRODUCT MERCHANDISING MACHINE

BACKGROUND OF THE INVENTION

This invention relates to multiple-product merchandising machines of the type which dispense different kinds and sizes from a drum mounted within a cabinet, and more particularly to a cooling system for such a machine.

One type of multiple product merchandising machine presently in use comprises a generally rectangular cabinet having a plurality of vertical walls and a rotatable drum mounted within the cabinet. The drum has a plurality of shelves spaced along its axis, and these shelf are divided by partitions into a plurality of compartments. The machine includes means for rotating the drum, and means for vending product from the compartments. Reference may be had to the inventor's co-pending patent application Ser. No. 07/112,475 filed Oct. 26, 1987, (incorporated herein by reference) for a more complete description of such a machine. This type of machine is suitable for vending a wide variety of products. However, in order to be suitable for vending many food products, it is desirable to provide some means for cooling the products stored in the compartments.

SUMMARY OF THE INVENTION

It is therefore among the objects of the present invention to provide a cooling system for a merchandise vending machine of the type comprising a rotatable drum with merchandise compartments mounted in a cabinet; to provide such a cooling system that evenly distributes cooling through all of the compartments; to provide such a system that is of simple, inexpensive and reliable construction; and to provide such a system that provides uninterrupted cooling to the compartments, even while the drum is rotating.

The cooling system of the present invention is adapted for use in a food storage and merchandising device of the type comprising a rectangular cabinet with vertical walls, and a rotatable drum mounted within the cabinet. The drum comprises a plurality of axially spaced shelves that are divided into a plurality of food storage compartments by partitions. The machine further comprises means for rotating the drum and means for vending food from the compartments. Generally, the cooling system of the present invention comprises a hollow center column extending axially through the drum and through the centers of the shelves. The column has a sidewall defining an air passageway, and the sidewall has a plurality of vents therein communicating with each of the food storage compartments. The top of the column is preferably capped to close the air passageway. The cooling system further comprises means for cooling air, and means for introducing air from the air cooling means into the air-passage. The cooling system also comprises air return means disposed remote from the drum, adjacent the vertical walls for receiving air which has passed through the compartments and returning it to the air cooling means.

The air return means may comprise at least one, and preferably three inner walls surrounding the drum and disposed adjacent the vertical walls of the cabinet to define a duct therebetween communicating with the air-cooling means. A divider may also be provided between the drum and at least one of the inner walls to define a temporary storage space between the divider and its respective inner wall. The divider preferably has a plurality of vents therein for the passage of air from the compartments, through the temporary storage space, and to the duct between the inner wall and its respective vertical wall.

The cooling system can thus cool merchandise, such as food, stored in the various compartments, and evenly distributes cooling through all of the compartments. The system is of simple construction, and thus is inexpensive and reliable. The system can continuously provide cooled air to the air passage, and thus provides uninterrupted cooling, even while the drum is rotating.

These and other advantages will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
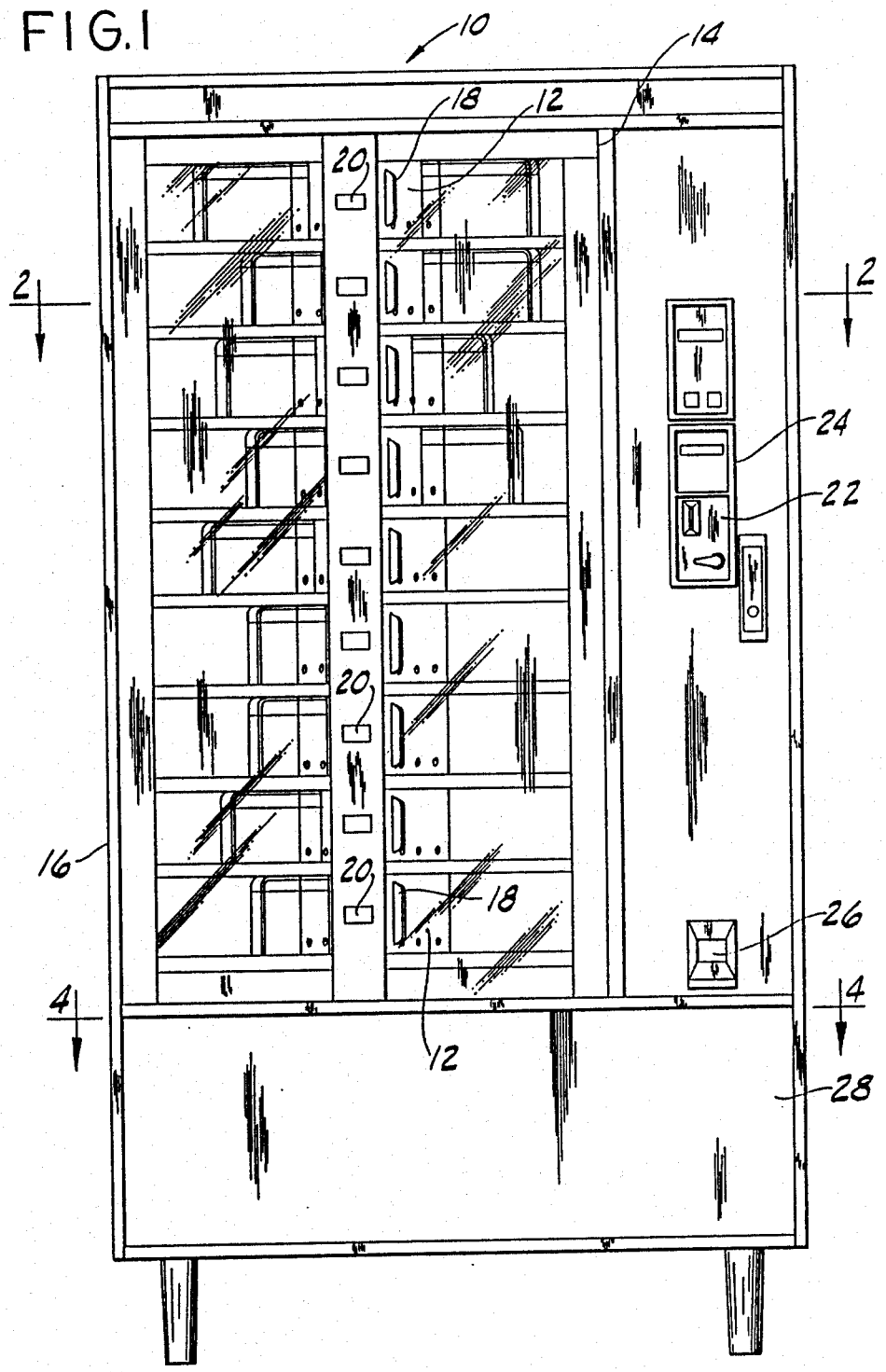
FIG. 1 is a front elevation view of a multiple-product merchandising machine incorporating the cooling system of the present invention.

A multiple-product merchandising machine of the type for which the cooling system of the present invention is adapted, is indicated generally as 10 in FIG. 1. The machine 10 comprises a generally rectangular cabinet 16 defined by a plurality of generally vertical walls. A front service door 14 forms most of the front wall of the cabinet 16 of the machine, and has a plurality of transparent access doors 12 slidably mounted therein for horizontal sliding movement between a closed, normally locked position, as they are shown in FIG. 1, and an open position which permits access to the interior of the cabinet 16. A handle 18 is mounted to or formed in each access door 12 to permit the doors to be manually moved between the open and closed positions. Adjacent each door 12 is a price display 20 which indicates the price of the product which can be purchased and removed from the adjacent door.

Also mounted in the service door 14 are coin and bill receiving and validating mechanisms 22 and 24, respectively, and a coin return receptacle 26, all of a form well known in the art. These mechanisms are adapted for vending merchandise from the machine 10, by releasing the access doors 12 when the appropriate amount of currency is deposited. A front skirt 28 forms the lower part of the service door 14 and covers an area of the cabinet 16 beneath the access doors 12 which houses refrigeration equipment, described more completely below.

Figure 2:
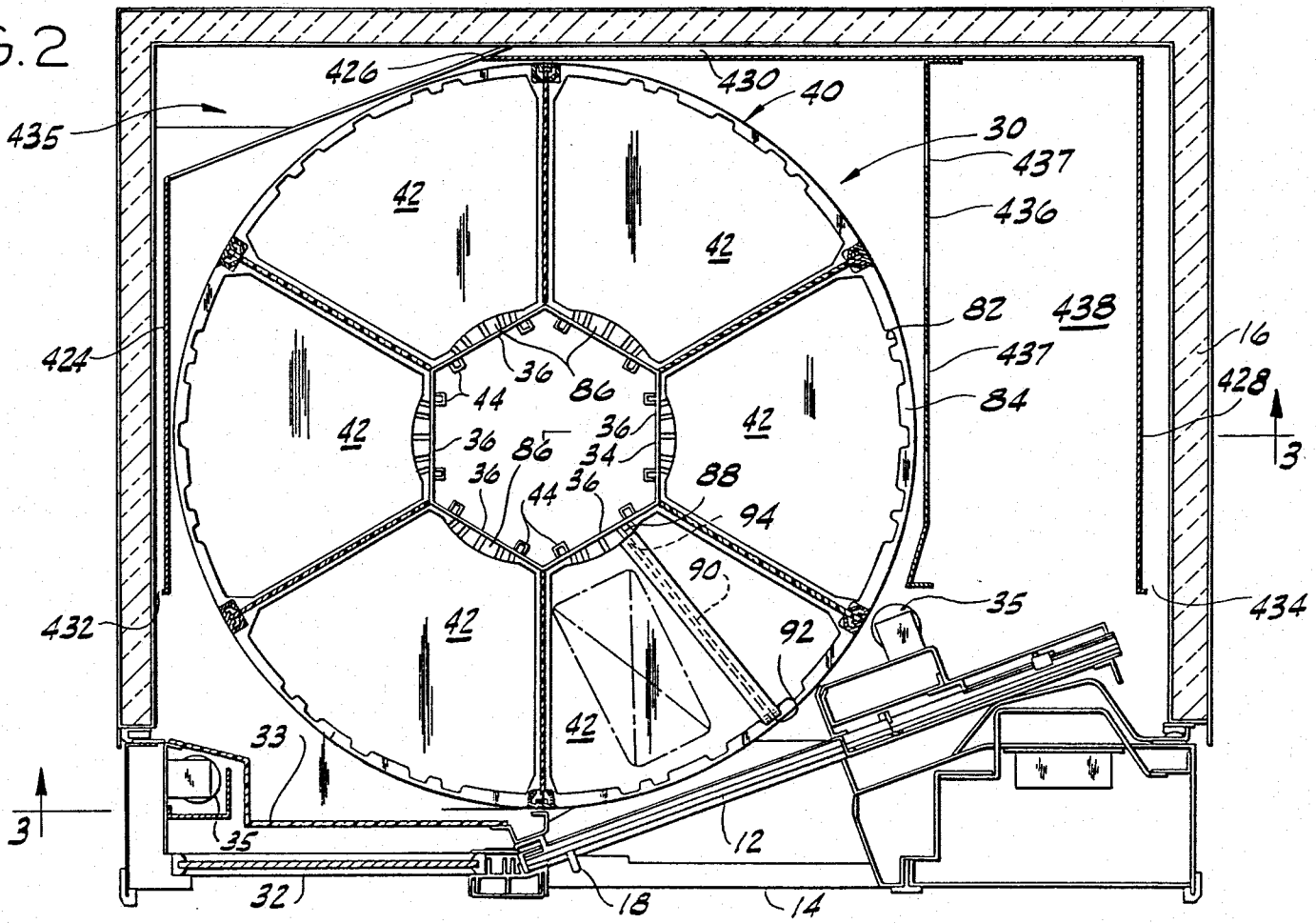
FIG. 2 is a cross-sectional view taken along the plane of line 2—2 in FIG. 1.

As shown in FIG. 2, mounted within the cabinet 16 for rotation is a generally cylindrical merchandise carrying drum 30 disposed behind the access doors 12 and a glass plate 32 forming an additional product viewing area behind which is a transparent plastic air deflection and insulation sheet 33. Fluorescent lights 35 are disposed on the service door 14 on each side of the viewing area to assist a customer in viewing the products.

The drum 30 is composed of a hexagonal sheet metal center column 34 which extends the full height of the drum. Each panel 36 which forms a side of the drum 30 has two rectangular holes 38 formed therein at the level of each of the axially spaced annular shelves 40. Each shelf 40 is composed of six identical transparent plastic trays 42, each of which has tabs 44 which are received in the respective holes 38 and rest on the lower edge thereof to position the trays around the column 34. Bolted or otherwise secured to the top of the column is a sheet metal top disk (not shown) with a diameter approximately the same as the diameter of the annular shelves 40, which substantially closes the column 34.

Figure 3:
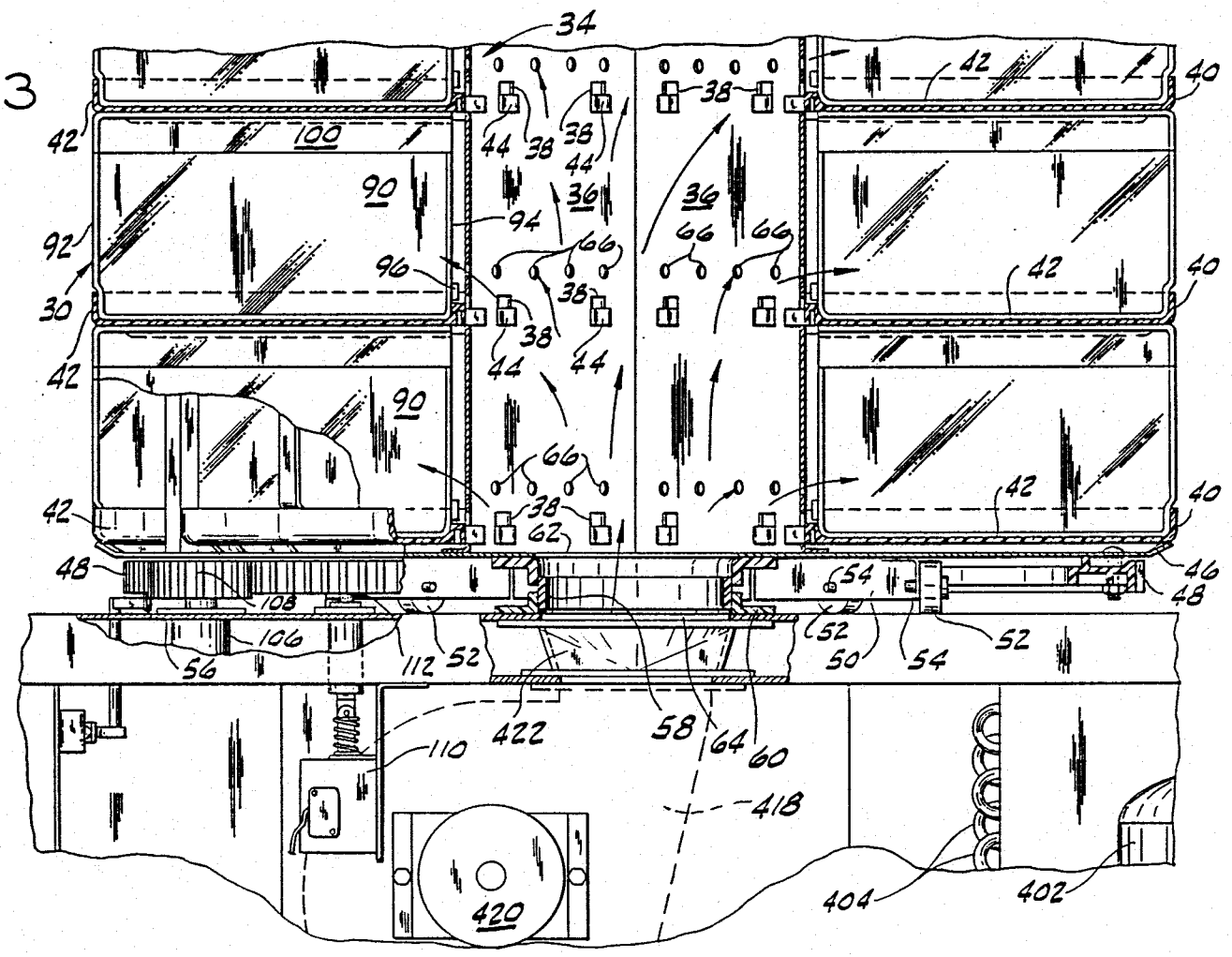
FIG. 3 is an enlarged, partial cross-sectional view taken along the plane of line 3—3 in FIG. 2.

The bottom of the column 34 is fastened to a sheet metal base disk 46, approximately the diameter of the annular shelves 40, as shown in FIG. 3. The base disk 46 has bolted thereto a plastic ring gear 48 with a diameter also approximately the diameter o the shelves 40. A sheet metal ring 50 with an L-shaped cross section is fastened to the bottom of disk 46 and has a diameter less than the diameter of the ring gear 48. The ring 50 supports a plurality of rollers 52 on pins 54 mounted on the ring 50. The rollers 52 ride on the upper surface of a sheet metal floor plate 56 which forms a floor to the merchandise containing area of the machine 10, to support the drum 30 for rotation.

An annular plastic sleeve 58 is secured to the lower surface of base disk 46 and is matingly received in annular plastic sleeve 60 secured to the floor plate 56. Both the base disk 46 and floor plate 56 have corresponding circular holes 62 and 64, respectively, which together with the sleeves 58 and 60 allow air to flow continuously from the lower portion of the cabinet into the center column 34. As described more completely below, air handling and refrigeration equipment contained in the lower portion of the cabinet 16 is used to force cold air into column 34 through the sleeves 58 and 60 where it is then distributed uniformly over the products on the shelves 40 by passing through the plurality of holes or vents 66 formed in each of the panels 36, as shown by the arrows in FIG. 3.

Also forming part of the merchandise carrying drum 30 are a plurality of walls 70, which in the preferred embodiment number six. Each of these walls 70 extend for the full height of the drum and are secured at their upper and lower ends to the top disk and base disk 46, respectively, of the drum 30 for rotation therewith. The walls 70 are preferably plastic and adjacent ones are alternately transparent and opaque for reasons discussed in detail below. Trays 42 extend between adjacent walls 70 to form with the walls a plurality of compartments around each shelf 40.

Each of the trays 42 is generally dish-shaped with short side walls and can be further subdivided into smaller compartments, as shown in FIG. 2. In each tray 42 there are provided a series of vertical channels 82 formed in the outer vertical edge wall 84 an facing the center column 34. In the preferred embodiment there are preferably five such channels which allow the tray to be divided in half, in thirds or in quarters. On the inner wall 86 of each tray are formed a series of grooves 88 which are aligned with the channels 82. Partitioning walls 90 are formed to be received in the channels 82 and grooves 88 to divide the trays as desired. The outer vertical edge 92 of each partitioning wall 90 is a wide flange which is matingly received in the channels 82. The inner vertical edge 94 of each partitioning wall 90 has a tab 96 (FIG. 3) extending from the lower portion thereof which is received in the notches 88.

In order to rigidify the partitions 90 they are designed to engage the bottom of the tray above them. To achieve this in the preferred embodiment the bottom of each tray 42 is provided with along tab (not shown) in alignment with the channels 82 and grooves 88 in each tray. A connecting piece 100 is provided which has a deep groove along its lower edge for receiving the upper edge of a partition 90 and has a shallower groove in its upper edge for receiving the long tab in the lower surface of a tray. To assemble a partition between a top and bottom tray, the partition is first placed in the bottom tray with its outer edge 92 in a desired channel 82 and its tab 96 in a corresponding groove 88 so that the lower edge of the partition abuts the upper surface of the bottom tray. The connecting piece 100 is then slid onto the top edge of the partition and simultaneously along the long tab until it is abutting the center column 34. This locks the partition rigidly in place. This assembly procedure is repeated for as many of the partitions as is desired. The partitions 90 are preferably all made of transparent plastic to allow a customer to see more product than is in a single compartment.

The drum 30 may be rotated by a reversible electric motor 106 (FIG. 3) whose operation is controlled by a microprocessor with special programming. The motor 106 has a gear 108 secured to its output shaft which is drivingly engaged with the ring gear 48 secured to the bottom of the drum 30. Rotation of the motor 106 in either direction to allow a customer to review product in various areas of the drum 30 may be controlled by buttons on the front of the cabinet 16. This allows a customer to rotate the drum 30 either left or right by pusing the appropriate button.

In order to accurately stop the turning of the drum 30 so that a selected compartment is located directly in front of the appropriate access door 12, a spring loaded solenoid 110 is used. When the motor 106 is to be activated the solenoid 110 is first activated to remove its plunger 112 from one of a series of corresponding holes (not shown) formed in the underside of the ring gear 48. There is a hole corresponding to each possible partition 90 and wall 70 location in the drum 30 so that each compartment can be exactly registered with an appropriate access door 12.

Figure 4:
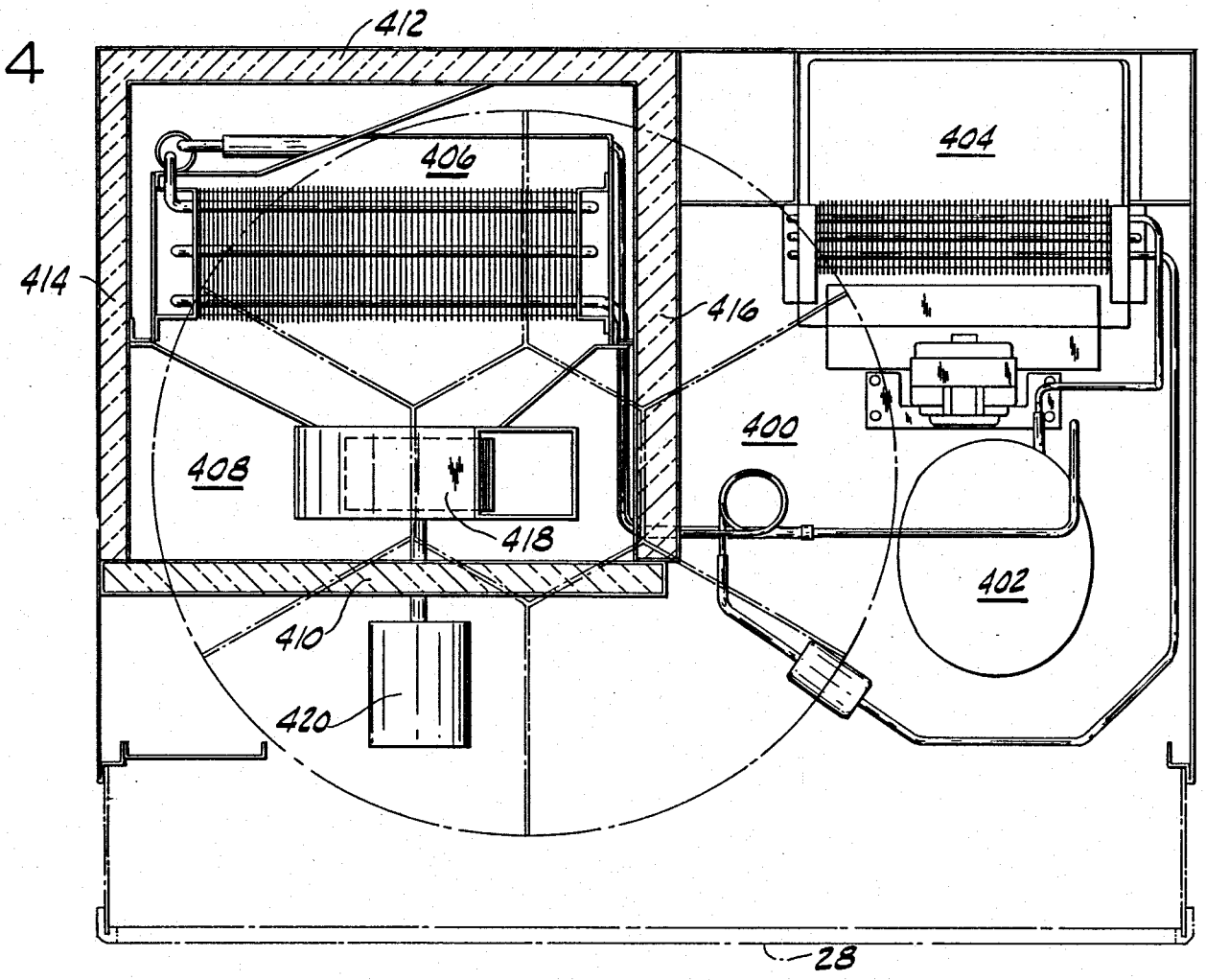
FIG. 4 is an enlarged partial cross-sectional view taken along the plane of line 4—4 in FIG. 1, with the position of the drum shown in phantom.

The cooling system of the present invention comprises the hollow center column 34 which defines an air passageway extending axially through the drum 30. Air cooling means, such as a refrigeration system 400, is disposed in the bottom of the cabinet 16, below floor plate 56. As best shown in FIG. 4, refrigeration system 400 comprises a compressor 402, a condenser coil 404, and an evaporator coil 406. Evaporator coil 406 is isolated in an insulated plenum 408, defined by insulated sidewalls 410, 412, 414, and 416. The evaporator coil 406 cools the air in the plenum 408.

A squirrel-cage blower 418 is provided in the plenum 408 and is driven by motor 420 located outside the plenum. The outlet of blower 418 communicates with a conduit 422 (see FIG. 3), which in turn communicates with hole 64 in floor plate 56 to introduce cooled air to the air passageway. The cooled air passes up through the air passageway and out through the various ports 66 to circulate evenly through the compartments. As described above, the top of column 34 is closed so that substantially all of the air introduced into air passageway exits through vents 66 to circulate through the storage compartments.

The cooling system further comprises air return means, disposed remote from the drum 30, adjacent the vertical walls of the cabinet for receiving air from the compartments and returning it the air cooling means. In the preferred embodiment, the air return comprises at least one and preferably three inner walls 424, 426, and 428 (see FIG. 2), disposed adjacent the vertical walls of the cabinet 16 to define a duct 430 therebetween communicating with the plenum 408. The inner walls generally surround the drum 30 on three sides. The duct 430 is open at the left and right sides 432 and 434, substantially along the entire height of the inner walls 424 and 428, to receive the air forced through the compartments.

As stated above, the duct 430 communicates with the plenum 408 via opening 435, which because of blower 418 is at a relatively lower pressure than the areas adjacent drum 30. Thus, the cooled air forced through the compartments passes radially outwardly from the drum, and is drawn through the elongate vertical slot openings formed between the edges of inner walls 424 and 428 and their respective vertical walls, into the duct 430. The air passes through opening 435 (FIG. 2) into the plenum 408.

A divider 436 may be disposed between the drum 30 and at least one of the inner walls, for example wall 428, to define a temporary storage space 438 between the divider 436 and its respective inner wall 428. The divider 436 preferably has a plurality of vents 437 therein for air to pass from the compartments, through the temporary storage space 438, to the duct 430.

OPERATION

In operation, the coil 406 cools air in the plenum 408. The blower 418 forces this cooled air through conduit 422, through the rotatable sealing means formed by sleeves 58 and 60, and into the air passageway defined by column 34. Because the top of the column is closed, substantially all of the cooled air provided to the column passes through vents 66, and is therefore evenly distributed over the storage components. Air leaving the compartments passes through opening 432 and 434 and into duct 430 through which it returns to plenum 408. At least some of the air from the compartments passes through divider 436 and through temporary storage space 438, to chill products temporarily stored therein for restocking the shelves.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a food storage and merchandising machine having a rectangular cabinet with vertical walls, a rotatable drum within the cabinet having a plurality of shelves spaced along the axis of the drum, the shelves being divided into a plurality of food storage compartments by partitions, means for rotating the drum, and means for vending food from the compartments, the improvement comprising a cooling system for cooling food stored in the compartments, the cooling system including:

a hollow center column extending axially through the drum and through the centers of the shelves, the column having a sidewall defining an air passageway, the sidewall having a plurality of vents therein communicating with each of the food storage compartments;

means for cooling air;

means for introducing air from the air cooling means into the air passageway; and air return means disposed remote from the drum, adjacent the vertical walls of the cabinet for receiving air which has passed from the air passageway through the compartments, and returning the air to the air-cooling means.

2. The apparatus according to claim 1 wherein the air return means comprises at least one inner wall disposed adjacent at least one of the generally vertical walls of the cabinet and defining a duct therebetween communicating with the air-cooling means.

3. The apparatus according to claim 2 wherein the air return means comprises three inner walls generally surrounding the drum on three sides.

4. The apparatus according to claim 3 wherein the inner walls are substantially the height of the drum and wherein the edges of the inner walls are spaced from the vertical walls to define an opening therebetween for the passage of air into the duct substantially along the entire height of the inner walls.

5. The apparatus according to claim 3 further comprising a divider disposed between the drum and at least one of the inner walls to define a temporary storage space between the divider and its respective inner wall, the divider having a plurality of vents therein for the passage of air from the compartments, through the temporary storage space and to the duct between the inner wall and its respective vertical wall.

6. The apparatus according to claim 5 wherein the air cooling means is disposed below the drum, and wherein the means for introducing air from the air cooling means into the air passageway comprises a conduit from the air cooling means and a rotatable seal means between the conduit and the air passageway for the uninterrupted delivery of air to the air passageway.

7. The apparatus according to claim 1 wherein cooled air is supplied adjacent one end of the air passageway and wherein the other end of the air passageway is blocked so that substantially all of the air provided to the air passageway passes through through the vents in the sidewall.

8. In a food storage and merchandising machine having a rectangular cabinet with vertical walls, a rotatable drum within the cabinet having a plurality of shelves spaced along the axis of the drum, the shelves being divided into a plurality of food storage compartments by partitions, means for rotating the drum and means for vending food from the compartments, the improvement comprising a cooling system for cooling food stored in the compartments, the cooling system including:

a hollow center column extending axially through the drum and through the center of the shelves, the column having a sidewall defining an air passageway, the sidewall having a plurality of vents therein communicating with each of the food storage compartments;

a plenum in the cabinet, below the drum;

means in the plenum for cooling air;

a conduit extending from the plenum for introducing air from the air cooling means into the bottom of the air passageway, the top of the air passageway being substantially blocked so that substantially all of the air introduced into the air passageway passes through the vents and into the compartments; and air return means disposed remote from the drum, adjacent the vertical walls for receiving air which has passed from the air passageway through the compartments, and returning the air to the plenum, the air return means comprising at least one inner wall disposed adjacent at least one of the vertical walls of the cabinet and defining a duct therebetween communicating with the plenum.

9. The apparatus according to claim 8 wherein the air return means comprises three inner walls generally surrounding the drum on three sides.

10. The apparatus according to claim 9 wherein the inner walls are substantially the height of the drum and wherein the edges of the inner walls are spaced from the vertical walls to define an opening therebetween for the passage of air into the duct substantially along the entire height of the inner walls.

11. The apparatus according to claim 9 further comprising a divider disposed between the drum and at least one of the inner walls to define a temporary storage space between the divider and its respective inner wall, the divider having a plurality of vents therein for the passage of air from the air passageway through the compartments, through the temporary storage space and to the duct between the inner wall and its respective vertical wall.

12. The apparatus according to claim 8 further comprising a rotatable seal means between the conduit and the air passageway for the uninterrupted delivery of air to the air passageway while the drum rotates.

* * * * *